United States Patent [19]

Mitter

[11] Patent Number: 4,498,318

[45] Date of Patent: Feb. 12, 1985

[54] APPARATUS FOR SUPPLYING FOAM TO A CONSUMER

[76] Inventor: Mathias Mitter, Falkenstr. 57, D-4815 Schloss Holte, Fed. Rep. of Germany

[21] Appl. No.: 450,108

[22] Filed: Dec. 15, 1982

[30] Foreign Application Priority Data

Dec. 23, 1981 [DE] Fed. Rep. of Germany ..... 3150936
Oct. 9, 1982 [DE] Fed. Rep. of Germany ..... 3237591

[51] Int. Cl.[3] ..... D06B 1/08

[52] U.S. Cl. ..... 68/200; 92/130 B; 118/694; 137/568; 222/56; 264/40.4; 422/106; 425/147

[58] Field of Search ..... 261/DIG. 26; 521/917; 137/568, 593; 252/359 E; 264/40.4; 425/147, 558; 422/106, 111, 114, 133; 417/540; 222/56; 118/694, 410; 68/200, 205 R, 207; 92/130 B, 130 C

[56] References Cited

U.S. PATENT DOCUMENTS

| | | | |
|---|---|---|---|
| 2,044,646 | 6/1936 | Stein | 92/130 B X |
| 3,337,195 | 8/1967 | Farison | 261/DIG. 26 |
| 3,434,805 | 3/1969 | Bar | 422/133 |
| 3,504,686 | 4/1970 | Cooper et al. | 137/568 X |
| 3,913,359 | 10/1975 | Childers et al. | 68/207 X |
| 4,158,076 | 6/1979 | Wallsten | 118/410 X |
| 4,396,133 | 8/1983 | Glaser | 425/558 X |
| 4,405,489 | 9/1983 | Sisbarro | 261/DIG. 26 |

FOREIGN PATENT DOCUMENTS

| | | | |
|---|---|---|---|
| 528616 | 5/1954 | Belgium | 137/593 |
| 2035220 | 7/1970 | Fed. Rep. of Germany . | |
| 2120683 | 2/1972 | Fed. Rep. of Germany | 222/56 |
| 2258892 | 12/1972 | Fed. Rep. of Germany . | |
| 2300298 | 1/1973 | Fed. Rep. of Germany . | |
| 2026492 | 7/1975 | Fed. Rep. of Germany . | |

*Primary Examiner*—Philip R. Coe

[57] ABSTRACT

Apparatus for supplying foam from the outlet of a continuously operated foam generator to a consumer which applies the liquid fraction of the foam to a substrate has a conduit which receives foam from the outlet and contains a storing device serving to take up the surplus of foam when the requirements of the consumer are less than the output of the foam generator and to satisfy the requirements of the consumer when such requirements exceed the output of the foam generator. The storing device contains a compensating device which ensures that the pressure of foam in the interior of the storing device is substantially constant, and such compensating device (which may consist of a reciprocable piston and a hollow piston rod receiving foam from the foam generator) can actuate a monitoring device which regulates the operation of the foam generator, of a pump which is installed between the foam generator and the storing device and/or a valve which can divert foam into a collecting receptacle. Movements of the piston in a direction to allow for an increase of the effective volume of the storing device are opposed by a cushion of compressed gas, and such movements are assisted by a weight which is attached to the piston rod.

42 Claims, 8 Drawing Figures

268
368
168
3
49
149
3c'
1a
1
10
13
249
468
161
61
9'
63
64
65
41
40
60D
44
3
3b

APPARATUS FOR SUPPLYING FOAM TO A CONSUMER

BACKGROUND OF THE INVENTION

The present invention relates to improvements in apparatus for conveying foamed compositions, for example, to improvements in apparatus for conveying foam from one or more foam generators to a station or unit where the foam (or certain ingredients of the foam) must be applied to a stationary or running substrate.

It is already known to contact a running or stationary substrate with a continuous or discontinuous stream of foam which is produced in one or more foam generators and is conveyed to the path for the substrate by one or more conduits. Reference may be had, for example, to German Offenlegungsschrift No. 25 23 062. The application of foam to substrates is one of numerous attempts to apply minute quantities of liquids with a high degree of accuracy. This is desirable, for example, in connection with the application of chemicals (such as pigments, liquors or the like) to textile materials, webs of paper, cords, strands and like commodities. A typical example of a commodity which is to be provided with accurately controlled quantities of liquor in one or more colors is a carpet whose nap is to be dyed or patterned but whose base layer should remain free of contact with the dye or dyes. The chemicals are dissolved in a liquid carrier (such as water), and the liquid carrier is admitted into a foam generator to increase its volume as a result of admission of bubbles of air or another gas. In many instances, the foaming of liquids takes place in the presence of tensides. The aforementioned German publication discloses an apparatus which includes means for generating foam by resorting to a structure which is capable of varying the ratio of gaseous fluid and the ratio of liquid fraction in the foam. This enables the apparatus of the German publication to produce foams of desired consistency. Other attempts to produce foams include resort to dispersion turbines whose operation is analogous to that of the foam generator means in the Offenlegungsschrift. The latter further discloses a foam applicator which can be used to bring the foam in contact with a running substrate. Other prior publications which disclose means for conveying foam toward and for applying foam to a substrate include U.S. Pat. Nos. 3,969,780, 4,193,762 and 4,208,173. The U.S. Pat. No. 3,969,780 discloses two foam generators which are mounted in parallel and serve to apply foam directly to a running web or the like.

All of the heretofore known apparatus exhibit certain serious drawbacks which affect the quality of the dyed or otherwise treated substrates or other types of workpieces. The primary reason for the failure of conventional apparatus under circumstances when the treating composition or compositions must be applied with a very high degree of accuracy and reproducibility is that the rate of consumption of foam at a station where the foam is applied to a substrate or the like often fluctuates within a wide range. The reasons for such fluctuations are numerous and include, among others, the extent to which the substrate can absorb foams. Such ability, in turn, depends on a variety of parameters which cannot be considered in heretofore known apparatus wherein the foam generator simply turns out foam of selected consistency and discharges it for transport to the applicator. The aforementioned parameters include, among others, the extent to which the liquid fraction is foamed, the rate of disintegration or decay of foam, the composition of tenside or tensides (if any) which are present in the foam, the consistency of the substrate, and the nature of preliminary or preceding treatment of the substrate. The capacity of the substrate to absorb liquids can vary within a wide range. Heretofore known attempts to account for such characteristics of the substrate include the provision of a bypass on the way from the foam generator to the consumer. To this end (and assuming that the consumer includes a squeegee which is to distribute foam over the surface of the substrate and draws foam from a chamber which is adjacent thereto, e.g., in the interior of a rotary cylindrical screen), a first valve is installed ahead of the chamber in the screen and such valve closes to prevent further admission of foam into the chamber when the latter is filled to a predetermined extent. The bypass contains a second valve which opens when the first valve closes and vice versa. Thus, when the momentary requirements of the consumer are satisfied, the second valve opens and permits the oncoming foam to enter a conduit leading to the drain. This can entail enormous losses in chemicals including highly expensive chemicals which are often employed in dyeing and similar plants.

OBJECTS AND SUMMARY OF THE INVENTION

An object of the invention is to provide an apparatus which is constructed and assembled in such a way that the foam is not wasted, even if the requirements of the consumer fluctuate within a wide range.

Another object of the invention is to provide an apparatus wherein the momentary surplus of foam need not be discarded.

A further object of the invention is to provide the apparatus with novel and improved means for connecting one or more foam generators with the consumer or consumers.

An additional object of the invention is to provide an apparatus which can be used as a superior substitute for heretofore known foam generating, dispensing and applying apparatus.

A further object of the invention is to provide a novel and improved method of conveying foam from one or more sources to the locale or locales of use.

An additional object of the invention is to provide an apparatus wherein each and every quantity of generated foam is used up by the consumer.

Another object of the invention is to provide the apparatus with novel and improved means for treating foam between the locus of generation and the locus of consumption.

An additional object of the invention is to provide the apparatus with novel and improved means for influencing the flow of foam between the maker and the consumer.

Another object of the invention is to provide the apparatus with novel and improved means for temporary storage of foam.

A further object of the invention is to provide an apparatus of the above outlined character which can be used for the application of foam to stationary or running consumers, whose versatility greatly exceeds that of heretofore known apparatus, which can generate, convey and apply a wide variety of foams, and which can stand extended periods of use with a minimum of attention on the part of the operators.

One feature of the invention resides in the provision of apparatus for feeding foam to at least one consumer, such as a device for applying foam to a substrate (e.g., a running carpet or the like) and whose requirements normally fluctuate (e.g., the foam applying device can form part of an intermittently operated consumer). The apparatus comprises at least one preferably adjustable foam generator having foam discharging outlet means, and means for connecting the outlet means of the foam generator with the consumer. The connecting means comprises at least one foam storing device. The storing device can constitute a buffer reservoir serving to store foam which is generated while the requirements of the consumer are less than the output of the foam generator (such buffer reservoir stores all of the foam which is generated while the requirements of the consumer are nil so that the foam generator need not be arrested).

The connecting means preferably further comprises preferably adjustable flow regulating means (e.g., one or more valves) installed between the storing device and the consumer, and means for adjusting the flow regulating means in accordance with a predetermined pattern and/or as a function of changes in the requirements of the consumer.

The storing device can comprise a vessel defining a path for the flow of foam from the foam generator toward the consumer and at least one foam guide which is installed in such path. The configuration of the guide is preferably streamlined so that it offers relatively low resistance to the flow of foam therealong. Several foam guides can be installed in the just mentioned path.

The storing device has a foam receiving portion and a foam discharging portion, and at least one of these portions can constitute or resemble a funnel. A foam guide can be installed in each such portion of the storing device, and at least one of the guides can constitute a twin cone. The foam guide and the respective portion of the storing device preferably define an annular passage having an at least substantially constant width.

As a rule, the quantity of foam in the storing device will fluctuate, and the apparatus can further comprise compensating means for varying the effective volume of the storing device as a function of fluctuations of the quantity of foam which is stored therein. The compensating means can be installed in the interior of the storing device. If the foam generator is adjustable, the apparatus can further comprise means for adjusting the foam generator as a function of variations of effective volume of the storing device; such adjusting means can form part of or can cooperate with the aforementioned compensating means. The latter can comprise an elastically deformable cushion which is installed in the storing device and contracts in response to increasing pressure of the confined foam. Alternatively, the compensating means can comprise a piston which is reciprocably received in the storing device and has a piston rod; the piston and the piston rod can define a channel for the flow of foam through the compensating means. In such apparatus, the storing device can comprise a cylinder for the piston, and the cylinder can include a foam admitting portion at one side of the piston, a foam discharging portion at the other side of the piston, and a chamber for the storage of foam between the piston and the foam discharging portion. The piston rod then extends outwardly through the foam admitting portion and is connected with the outlet means of the foam generator so that the channel admits foam into the aforementioned chamber. Such apparatus can further comprise means (e.g., one or more weights) for biasing the piston in a direction to reduce the volume of the chamber. The foam generator can be adjusted as a function of changes in the position of the piston with reference to the cylinder of the storing device; to this end, the means for adjusting the foam generator can comprise one or more limit switches which are connected with the foam generator and are actuatable by the piston or by a part which shares the movements of the piston with reference to the storing device.

The consumer can comprise one or more squeegees (e.g., in the form of slotted doctor blades), and the aforementioned connecting means can be designed to supply foam to one end portion of such squeegee. The other end portion of the squeegee can receive foam from a second connecting means which delivers foam from a second foam generator or from the same foam generator. The consumer preferably further comprises a stationary or rotary screen which is interposed between the squeegee and the substrate so that the foam must pass through the interstices of the screen (and thereby loses at least the major percentage of its bubbles) on its way into contact with the substrate.

As mentioned above, the apparatus can further comprise compensating means for varying the effective volume of the storing device as a function of fluctuations in the quantity of foam which is confined in the storing device. In accordance with a presently preferred embodiment of the invention, the compensating means comprises the aforementioned piston which is reciprocable in the storing device and the compensating means further comprises conduit means connecting the piston with the outlet means of the foam generator. The conduit means includes a portion which constitutes a piston rod rigid with the piston and extending from the storing device. The piston divides the interior of the storing device into first and second chambers and the foam discharging portion of the storing device communicates with one of these chambers. The piston and its piston rod define a channel for admission of foam from the foam generator into the one chamber.

The apparatus further comprises means for monitoring the quantity of foam in the storing device, and such monitoring means includes or can include means for generating signals in response to movement of the piston with reference to the storing device, i.e., in response to a change in the effective volume of the storing device. Such signals can be used to adjust the foam generator, to adjust a pump which is installed in the conduit means between the foam generator and the storing device and/or to adjust one or more valves in such conduit means and/or in the conduit or conduits supplying gaseous and liquid fractions to the foam generator.

The apparatus can further comprise foam distributor means which is installed in the one chamber and is spaced apart from the outlet of the channel which is defined by the piston and its piston rod. The distributor means comprises an extension (e.g., a substantially conical portion) which faces the foam discharging portion of the storing device and defines with the latter at least one passage for the flow of foam from the channel, through the one chamber and on to the consumer.

The conduit means between the piston and the foam generator can comprise a flexible portion which serves to convey foam into the aforementioned channel, i.e., into the piston rod.

The apparatus can further comprise means for urging the piston in a direction to increase the volume of the one chamber. Such urging means can comprise one or more weights which are attached to the piston rod, i.e., to a portion of the conduit means.

The consumer can comprise a screen and the connecting means is then preferably arranged to supply foam to one side of the screen. The consumer further comprises means (e.g., a squeegee) for inducing or forcing the flow of foam through the screen, e.g., into contact with a substrate at the other side of the screen.

In accordance with a modification, the apparatus can comprise two or more connecting means each of which receives foam from the outlet means of the foam generator and each of which supplies foam to the consumer along a discrete path. The length of each such path is preferably the same; this ensures that the consistency of the foam reaching the consumer remains unchanged or changes to the same extent irrespective of the path along which the foam advances from the foam generator to the consumer.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
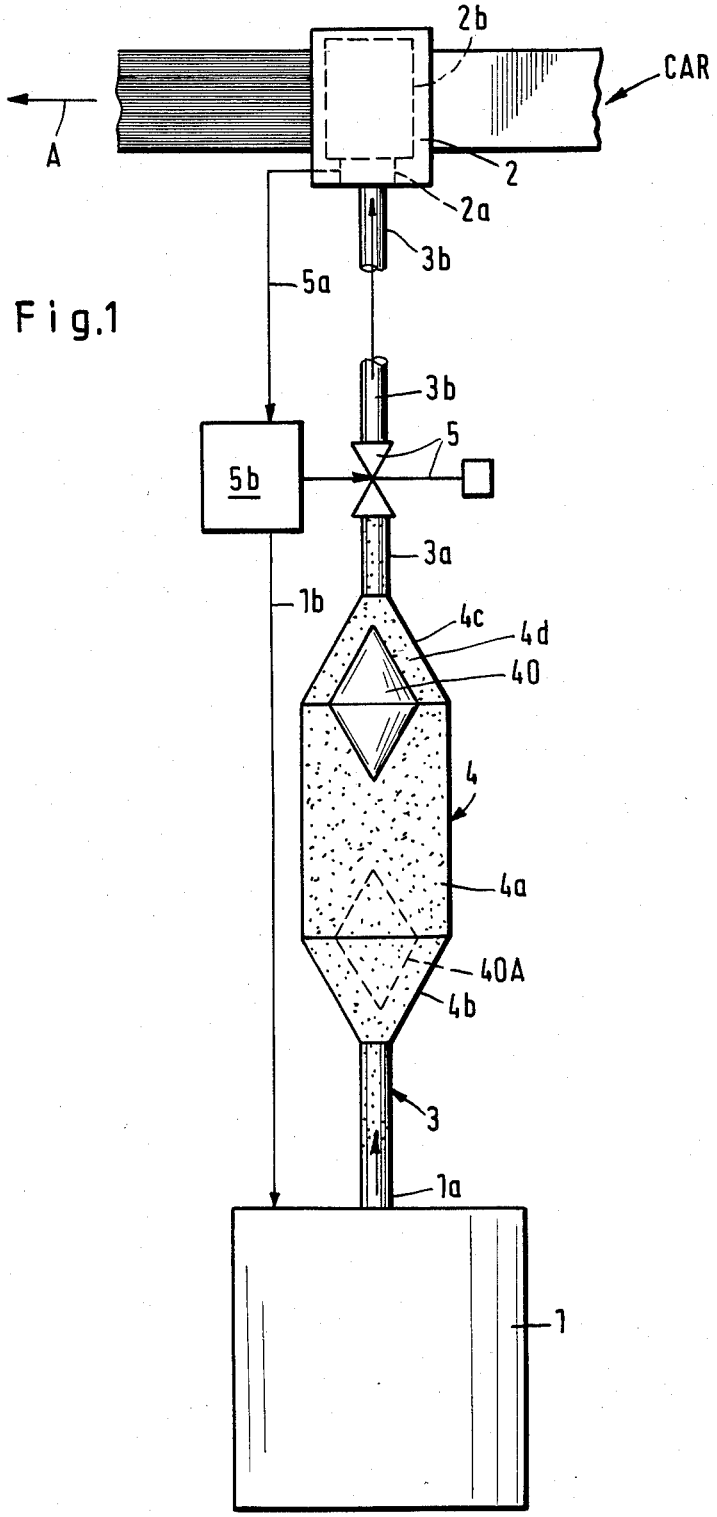
FIG. 1 is a fragmentary schematic partly elevational and partly sectional view of an apparatus which embodies one form of the invention.

FIG. 1 illustrates an apparatus which comprises a foam generator 1 and means for connecting the outlet 1*a* of the foam generator with a consumer 2. The connecting means comprises a conduit 3, which is connected with the outlet 1*a*, and a storing device 4 which is installed in and can be said to constitute an enlarged portion of the conduit 3. The diameter of the preferably cylindrical central portion 4*a* of the storing device 4 can considerably exceed the diameter of the conduit 3, and this storing device (which is actually an elongated vessel) has a funnel-shaped (frustoconical) foam admitting portion 4*b* and a similarly configurated foam discharging portion 4*c*. The main purpose of the storing device 4 is to act as a buffer (first-in, first-out) reservoir, i.e., to accept and confine the surplus of foam when the output of the foam generator 1 exceeds the requirements of the consumer 2, and to meet the requirements of the consumer when such requirements exceed the output of the foam generator.

A flow regulating device 5 (e.g., a manually and/or automatically adjustable valve) is interposed between the sections 3*a* and 3*b* of the conduit 3 downstream of the storing device 4. The purpose of the flow regulating device 5 is control the rate of flow of foam from the portion 4*c* of the storing device 4 into the consumer 2 proper. The arrangement may be such that the flow regulating device 5 is adjusted in automatic response to changing requirements of the consumer 2.

The interior of the storing device 4 accommodates a foam guide 40 which resembles or constitutes a twin cone (i.e., two cones with the exposed sides of their bases placed against one another) and is installed in the storing device in such a way that its upper cone, as viewed in FIG. 1, defines with the adjacent portion 4*c* an annular passage 4*d* of at least substantially constant width. It will be noted that the shape of the storing device 4 and of the guide 40 is streamlined so that such parts offer little resistance to the flow of foam toward and in the channel 4*d*. The guide 40 cooperates with the portions 4*a* and 4*c* of the storing device 4 to ensure uniform flow of foam toward the section 3*a* of the conduit 3. Moreover, the just discussed configurations of the guide 40 and of the storing device 4 ensure that the latter does not exhibit any dead corners which would gather batches of foam for extended periods of time such as would suffice to allow for at least partial decomposition of the foam. This would affect the quality of the substrate CAR which receives foam or one or more constituents of foam from the consumer 2. The manner in which the guide 40 is secured to the storing device 4 (e.g., by resort to one or more substantially radially extending spokes or ribs offering minimal resistance to the flow of foam therearound) is not specifically shown in the drawing.

If desired or necessary, a second foam guide 40A (shown by broken lines) can be installed in the storing device 4 to cooperate with the portions 4*a* and 4*b* in the same way as shown for the foam guide 40. Thus, the foam guide 40A and the portion 4*b* can define a second annular passage of at least substantially constant width.

The foam generator 1 is supposed to operate in such a way that its outlet 1*a* delivers a continuous stream of foam. This is desirable and advantageous for several reasons, especially as concerns the quality of the produced foam. As a rule, the quality of foam is not satisfactory immediately after a foam generator is started, and the interval of delivery of unsatisfactory foam can take several minutes with attendant losses in output and/or defective treatment of the substrate (CAR) which receives foam from the consumer 2. The storing device 4 enables the consumer 2 to operate intermittently and/or to increase or reduce its requirements within a wide range without actually interrupting its operation. As stated above, the flow regulating device 5 can be adjusted by the consumer 2 (this is indicated in FIG. 1 by a line 5*a* denoting an electrical or other connection serving to transmit signals from a monitoring device 2*a* in or on the consumer, such monitoring device serving to detect the quantity of foam in the consumer and to transmit signals which are used by a servomotor 5*b* to adjust the regulating device 5 accordingly, i.e., to reduce the rate of flow of foam from the storing device 4 when the quantity of foam in the consumer 2 rises to a preselected maximum permissible value and to increase the rate of flow of foam from the storing device when the quantity of foam which is stored in the consumer 2 decreases or reaches a preselected minimum value). It is equally within the purview of the invention to adjust the regulating device 5 as a function of variations (if they exist) of the output of the foam generator 1. This is indicated by a line 1*b* leading from the foam generator 1 to the servomotor 5*b* for the regulating device 5. In most instances, the output of the foam generator 1 need not be changed, i.e., it is normally sufficient to make the setting of the adjustable flow regulating device 5 conform to the fluctuations in the foam requirements of the consumer 2 irrespective of whether the consumer is operated intermittently or its requirements merely fluctuate between a preselected minimum and a preselected maximum demand. Such mode of operation of the consumer 2 is normally desirable or necessary when the consumer is required to apply foam or one or more constituents of foam to a stationary or running substrate CAR, e.g., to the nap of a carpet which is advanced in the direction of arrow A. As a rule, the foam will be caused to pass through the interstices of a screen 2*b* which forms part of the consumer 2 and eliminates or reduces the percentage of bubbles in the foam before the liquid fraction of the foam reaches the nap of the carpet.

An important advantage of the improved apparatus is that the quality of the foam is not affected by the mode of operation of the consumer 2, i.e., the consumer can be operated intermittently or it can be caused to operate continuously but with pronounced fluctuations in the consumption of foam. Such unpredictable operation of the consumer need not affect the operation of the foam generator 1 so that the latter can continuously furnish foam of optimum quality and consistency. The adjusting means including the foam monitoring device 2*a* ensures that the consumer 2 invariably receives requisite quantities of foam, even if each period of operation of the consumer is followed by a relatively long or relatively short interval of complete or nearly complete standstill. Thus, the regulating valve 5 is opened or closed to the extent which is determined by the monitoring device 2*a* so as to admit into the conduit section 3*b* foam in quantities which are needed to meet the momentary requirements of the consumer 2.

Another important advantage of the improved apparatus is that the periods of dwell of large or substantial quantities of foam in the conduit or conduits are avoided by the simple expedient of storing the required surplus in the interior of the device 4. The retention of substantial quantities of foam in one or more conduits for extended periods of time is undesirable because the pressure per unit area of the small-diameter column of foam in the conduit or conduits is much higher than the pressure per unit area of the large-diameter column of foam in the interior of the storing device 4. Therefore, the decomposition of foam in the device 4 is much less pronounced than in the conduit or conduits connecting such device with the foam generator and with the consumer. The dimensions of the storing device 4 are preferably selected with a view to ensure that there is no need for pronounced pressurization of the confined foam. The higher the pressure in the storing device, the more likely is the confined foam to decay and to yield two discrete (gaseous and liquid) fractions. It has been found that a relatively small storing device normally suffices to avoid excessive pressurization of the foam therein while the foam is permitted to flow from the foam generator to the storing device and from the storing device to the consumer. Of course, the dimensions of the storing device 4 are also a function of certain other variables, such as the extent to which the requirements of the consumer 2 fluctuate, the maximum requirements of the consumer and the mode of operation of the consumer, i.e., the duration of intervals of idleness and the extent of fluctuations of the requirements between a maximum and a minimum value.

Consumers which can be used in the apparatus of the present invention are disclosed, for example, in German Pat. No. 20 26 492, in German Pat. No. 22 58 892 and in German Offenlegungsschrift No. 20 35 220. These publications disclose consumers with screens; however the consumer can also operate without a screen if the foam is to be applied directly to a substrate. If the consumer employs a screen and a squeegee, e.g., a squeegee which defines an internal compartment for reception of a supply of foam, the pressure of foam can equal or exceed atmospheric pressure. Such a squeege is normally mounted in adjustable bearings which are accessible externally of the screen.

Figure 2:
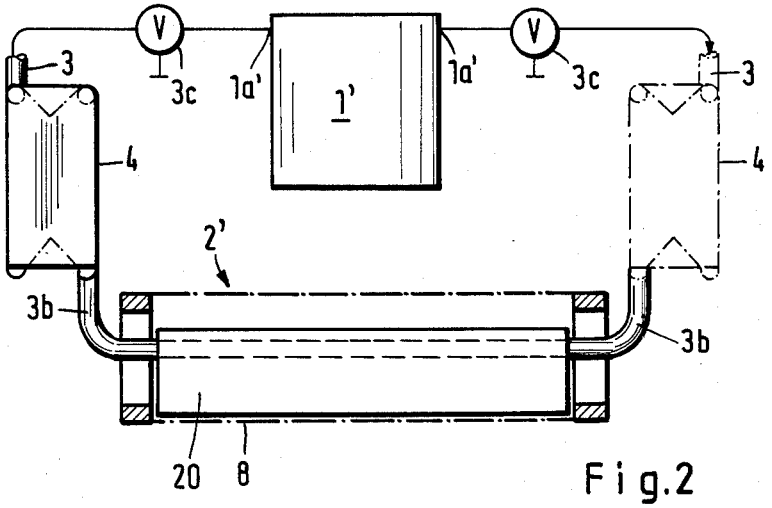
FIG. 2 is an enlarged partly schematic and partly sectional view of a portion of a second apparatus wherein the means for connecting the foam generator with the consumer comprises two discrete foam storing devices.

FIG. 2 illustrates a consumer 2' in greater detail. The reference character 8 denotes a cylindrical screen or stencil confining a squeegee 20, e.g., a roller or a slotted doctor receiving foam at each of its axial ends. The exact construction and mounting of the screen 8 and squeegee 20 form no part of the present invention. Reference may be had, for example, to the commonly owned copending application Ser. No. 393,881 filed June 30, 1981. By way of example, the squeegee 20 may be of the type operating with an internal elastically deformable cushion acting as a regulating means. A similar squeegee is disclosed, for example, in German Offenlegungsschrift No. 23 00 298 to which reference may be had, if necessary. Squeegees of much simpler design can be used with equal or similar advantage.

Each axial end of the squeegee 20 receives foam from the section 3*b* of a discrete conduit 3 containing a discrete storing device 4 which, in turn, can receive foam from a discrete foam generator. The regulating devices 5 have been omitted in FIG. 2 for the sake of clarity. It is also possible to utilize a single foam generator (1') whose outlet or outlets (1*a'*) supply foam to each of the two conduits 3, i.e., to each of the storing devices 4 shown in FIG. 2. Such an apparatus is especially advantageous when the foam is used for impression of patterns to a substrate and the cylinder 8 is a stencil with groups of interstices distributed with a view to provide a selected design. However, the apparatus which employs the structure of FIG. 2 can be used with advantage also when the purpose of the consumer 2' is to apply a uniform coat of coloring matter to the substrate which is advanced below the screen 8. The two storing devices 4 of FIG. 2 ensure that the squeegee 20 invariably receives requisite quantities of foam irrespective of gradual or abrupt fluctuations of foam consumption (such as may be dictated, for example, by the absorptivity of the substrate). The regulating device 5 is not absolutely necessary, i.e., the storing devices 4 of FIG. 2 can deliver foam directly into the sections 3*b* of the respective conduits 3 for admission into the interior of the screen 8 and into the range of the squeegee 20.

The apparatus of FIG. 2 can be modified by installing a valve 3*c* in each of the two conduits 3. This enables an attendant or an automatic programming device (e.g., a suitable computer) to seal the foam generator 1' from the left-hand or from the right-hand storing device 4, or to allow each of these storing devices to receive foam from the respective outlet 1*a'* of the foam generator. The number of storing devices which cooperate with a single foam generator can be increased to three or more, depending on the dimensions of the storing devices, on the output of the foam generator, on the requirements of the consumer and/or other factors. This would amount to a simple or even somewhat complex multiplication of the structure shown in FIG. 2.

The provision of one or more storing devices is particularly desirable and advantageous in apparatus wherein the consumer comprises a slotted squeegee because such types of squeegees can apply large quantities of foam per unit of time. This holds true irrespective of whether the squeegee operates with or without a cushion of compressed gas as disclosed in the aforementioned German Offenlegungsschrift No. 23 00 298. It is necessary to process a relatively large quantity of foam in order to provide the substrate with a relatively small quantity of liquid, and squeegees of the type disclosed in this German publication are capable of applying large quantities of foam which can be readily supplied by connections including one or more storing devices. As shown in FIG. 2, the just discussed types of squeegees can receive streams of foam at both axial ends.

It has been pointed out already that the provision of one or more storing devices is particularly desirable when the apparatus comprises or is designed to supply foam to an intermittently operated consumer. Thus, the foam generator need not be arrested, even if the consumer's requirements drop to zero for extended intervals of time, as long as the storing device or devices 4 are capable of accepting and temporarily storing the surplus which accumulates while the consumer is idle or while its requirements are reduced to zero for other reasons, e.g., because a portion of the substrate refuses to absorb any liquid. However, the provision of one or more storing devices is equally or nearly equally beneficial if the requirements of the consumer fluctuate within a wide range, for example, because the screen 8 includes one or more portions which are impermeable to a fluid medium. This is often the case when the substrate is to be provided with a pattern, e.g., a pattern including uncoated or undyed portions alternating (either regularly or in random fashion) with dyed portions.

The consistency of the foam depends on the nature of the substrate and on the nature of the desired treatment. The substrate can be colored, patterned or coated with one or more chemicals for a purpose other than dyeing or printing (patterning). For example, the foam can constitute a latex foam, it can contain one or more substances which prolong the useful life and/or enhance the quality, lustre, flexibility, stiffness or other characteristics of the treated material. In fact, the foam can simply constitute a washing medium which is applied to contaminated substrates to remove impurities from their nap.

The substrate which is to be treated by the improved apparatus can be stationary or it may be moved past the consumer. For example, the substrate may constitute a continuous length of carpeting, paper, cords, strands, strips or other bodies, preferably of fibrous material. This includes all kinds of textiles (i.e., not only carpeting but also velvets, fleeces, felts, plush and/or others). Still further, the substrate can consist of or contain one or more synthetic plastic substances in the form of foils or the like. For example, foils can be coated with one or more protective layers, or the applied foams can contain chemicals which attack and thereby etch a design in the respective sides of the substrates. The substrates can be woven or nonwoven, and they may constitute continuous webs or discrete sheets of paper or the like. Parallel strands of discrete filaments or groups of filaments can be treated just as well.

The foam can be applied to the selected surface of a substrate and the thickness of the applied foam layer is thereupon simply equalized. Alternatively, the exposed surface of the foam layer can follow the outline of the respective surface of the substrate. Still further, the foam, or at least its liquid constituent, can be forced into the material of the substrate by resort to the mechanical pressure which is furnished by a squeegee and/or by placing a suction generating device at the underside of the substrate (provided, of course, that the substrate is permeable to fluids). It is often preferred to apply only the liquid constituent of the foam to a substrate, e.g., to the nap of a carpet. This can be readily achieved by resorting to a consumer which employs a screen, such as the part 8 shown in FIG. 2.

In addition to the previously enumerated parameters which are likely to or actually influence the dimensions of the storing device or devices 4, such parameters further include the speed at which the substrate is advanced past the consumer, the width of the substrate, the consistency of the substrate (e.g., the thickness of the nap on a carpet and/or the absorptivity of the nap) and/or a combination of such variables. The dimensions of the storing device or devices 4 can further depend on the selected foam generator, particularly on the output of the foam generator. Still further, the dimensions of the storing device or devices will depend on the selected nature of foam, i.e., whether or not the foam is to contain large, medium-sized or small bubbles of a gaseous fluid. For example, the ratio of gas to liquid in the foam which is supplied by the foam generator can be ten-to-one. However, and as will be explained hereinafter, the foam generator is preferably adjustable so that the diameters of the bubbles can be varied within a wide range.

The length of the path which is defined by the left-hand connecting means 3, 4 for the flow of foam from the respective outlet of the foam generator 1' to the consumer 2' is preferably identical with the length of the path which is defined by the right-hand connecting means. This is desirable and advantageous because it ensures that the consistency of foam reaching the consumer 2' via one of the paths is the same as the consistency of the foam reaching the consumer by flowing along the other path. The same preferably holds true if the outlet means of the foam generator is or are connected with the consumer by three or more connecting means each of which comprises a discrete storing device.

It must be borne in mind that the consistency of foam tends to change. For example, if the foam is kept at a standstill, the bubbles of gaseous fluid burst and the stagnant foam develops pools of liquid fraction which can constitute barriers to further flow of foam thereabove or therebehind. Such accumulations of pools of liquid and of stale foam above or behind the pools of liquid affect the predictability of application of liquid to a substrate by causing the development of spots which detract from the appearance of the product irrespective of whether the liquid fraction is to provide the substrate with a monochroic coat or with a pattern of different colors or different shades of one and the same color. The situation is aggravated if the screen (2*b* or 8) is a stencil wherein the interstices form a pattern, i.e., when the permeability of the screen is not uniform. Such types of screens are likely to interfere, to a certain extent, with highly predictable application of the liquid fraction and, therefore, it is then even more important to ensure that the consistency of foam reaching the screen be as uniform as possible. The speed at which the substrate is moved past the liquid applying station (i.e., past the consumer) is also an important factor. If the speed of the substrate is relatively low, the rate of application of foam (i.e., the rate of consumption of foam) is also rather low since the consumption of foam is directly proportional to the speed of the substrate and to the ability of the substrate to absorb or otherwise accept the liquid fraction. If the speed of the substrate is very high, and if the application of liquid fraction takes place through the interstices of a screen, the conversion of foam into a released gaseous fraction and a liquid fraction (such as dyeliquor) takes place at a very high rate. In such situations, the provision of one or more storing devices represents the difference between success and failure since the foam generator normally operates at a constant rate and, if the consumption of foam at the locus of application to the substrate varies, the foam is bound to stagnate at times somewhere between the foam generator and the consumer if the apparatus lacks one or more storing devices. The storing device or devices constitute one or more reservoirs which compensate for deviations of foam consumption from foam generation and which ensure that the foam generator can produce foam at a constant rate (or at a substantially constant rate) even if the rate of flow from the storing device or devices to the consumer is subject to pronounced fluctuations or interruptions.

Figure 3:
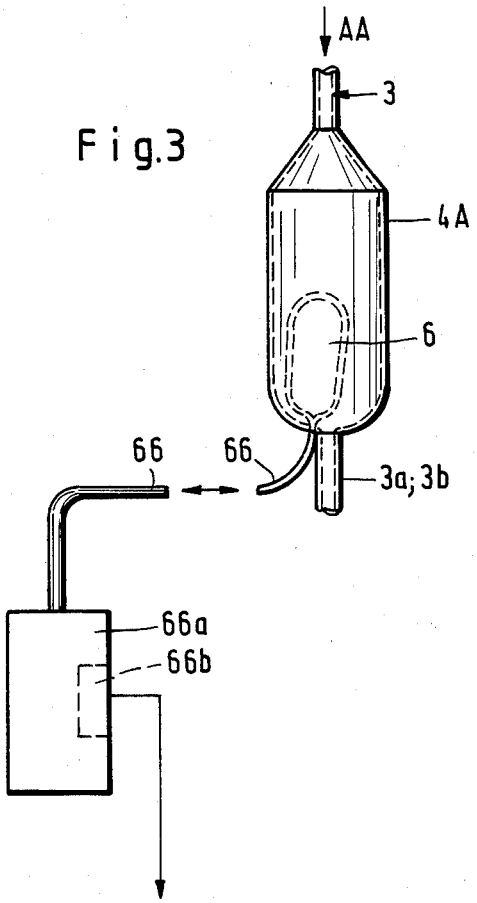
FIG. 3 is a schematic elevational view of a modified foam storing device with a balloon which constitutes a device that compensates for variations in the quantities of confined foam.

FIG. 3 shows a portion of a further apparatus wherein the conduit 3 including the sections 3*a* and 3*b* contains a somewhat modified storing device 4A receiving foam in the direction of arrow AA and containing a compensating device 6. The latter serves to vary the effective volume or capacity of the storing device 4A as a function of fluctuations of the quantity of foam which is stored in the device 4A. The compensating device 6 can further serve to regulate the operation of the foam generator (not shown) which supplies foam in the direction of arrow AA. The compensating device 6 of FIG. 3 is or can constitute a simple balloon which is elastically deformable in response to increasing pressure of the surrounding foam and thereby expels some of the fluid which is confined therein via conduit 66. The balloon may be made of rubber or other elastomeric material. The provision of a compensating device in, or in association with, the storing device 4A is particularly desirable and advantageous if the apparatus contains a flow regulating device between the storing device and the consumer. The conduit 66 can be connected to a source 66*a* of pressurized gaseous fluid; such source receives gas from the compensating device 6 when the quantity of stored foam increases, and the device 6 receives gas from the source 66*a* when the quantity of stored foam is reduced in response to increasing requirements of the consumer. The pressure in the source 66*a* can be monitored by a suitable detector (e.g., a pressure-responsive electronic transducer 66*b*) which regulates the operation of the foam generator so that the output of the foam generator is a function of foam pressure in the storing device 4A.

The provision of a compensating device 6 (or another suitable compensating device) is also important and advantageous if the requirements of the consumer fluctuate within a wide range. The compensating device 6 then causes the transducer 66*b* to regulate the output of the foam generator as a function of fluctuations in the requirements of the consumer.

Figure 4:
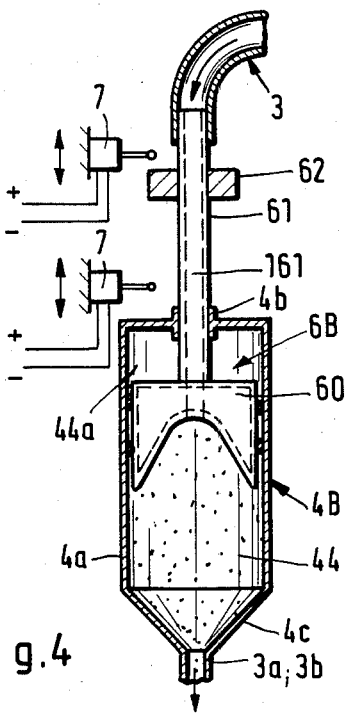
FIG. 4 is a fragmentary schematic partly elevational and partly sectional view of another apparatus with a storing device which accommodates a modified compensating device also serving as a means to adjust the foam generator.

Referring to FIG. 4, there is shown a portion of a further apparatus wherein the storing device 4B contains a modified compensating device 6B including a piston 60 which is reciprocable in the cylindrical portion 4*a* of the storing device and a piston rod 61 which extends outwardly through and beyond the foam admitting portion 4*b* of the storing device. The free end of the piston rod 61 is coupled to the conduit 3 so that the axial passage 161 (extending through the piston 60 and piston rod 61) of the compensating device 6B can admit foam from the foam generator (not shown) into a chamber 44 between the piston 60 and the frustoconical foam discharging portion 4*c* of the storing device. The reference character 62 denotes a portion of the bearing for the reciprocable piston rod 61. The conduit 3 (or at least that section of this conduit which is coupled to the exposed rear end of the piston rod 61) may constitute a flexible hose. When the quantity of foam which is stored in the chamber 44 increases, the piston 60 moves upwardly, as viewed in FIG. 4, and enables the storing device 4B to confine a larger quantity of foam. Inversely, the piston 60 moves toward the section 3*a* to reduce the volume of the chamber 44 when the rate of evacuation of foam from the storing device 4B increases. The piston 60 can descend (as viewed in FIG. 4) by gravity or in response to the action of suitable biasing means (such as one or more coil springs in the chamber 44*a* behind the piston). Alternatively, the storing device 4A can be mounted in at least substantially upright position and the part which is denoted by the character 62 can constitute a mass or weight which is affixed to the piston rod 61 and urges the entire compensating device 6B in a direction to reduce the volume of the chamber 44. The mass of the weight 62 will determine the resistance which the piston 60 offers to lifting by the supply of foam which is confined in the chamber 44. The entire piston 60 may but need not be hollow; it suffices if the parts 60 and 61 provide a passage for the flow of foam from the foam generator into the chamber 44.

In addition to serving as a means for biasing the piston 60 in a direction to reduce the volume of the chamber 44, the weight 62 can perform an additional function, namely, that of a trip serving to actuate selected limit switches 7 which are adjacent to the path of movement of the piston rod 61 and are in circuit with and form part of means for regulating the operation of the foam generator. The lower limit switch 7 of FIG. 4 is actuated by the biasing device 62 when the quantity of stored foam has been reduced to a minimum permissible value whereby the foam generator increases its output and the foam entering the chamber 44 causes the piston 60 to rise. The piston 60 (through the medium of the piston rod 61 and biasing device 62) actuates the upper limit switch 7 if and when the volume of the chamber 44 is increased to a certain (e.g., maximum permissible) value. As stated above, the means for adjusting the foam generator is preferably designed to merely accelerate or decelerate but not to cause even short-lasting stoppages of the foam generator. This would (or would be likely to) involve the making of unsatisfactory foam for a certain interval of time following restarting of the foam generator.

Figure 5:
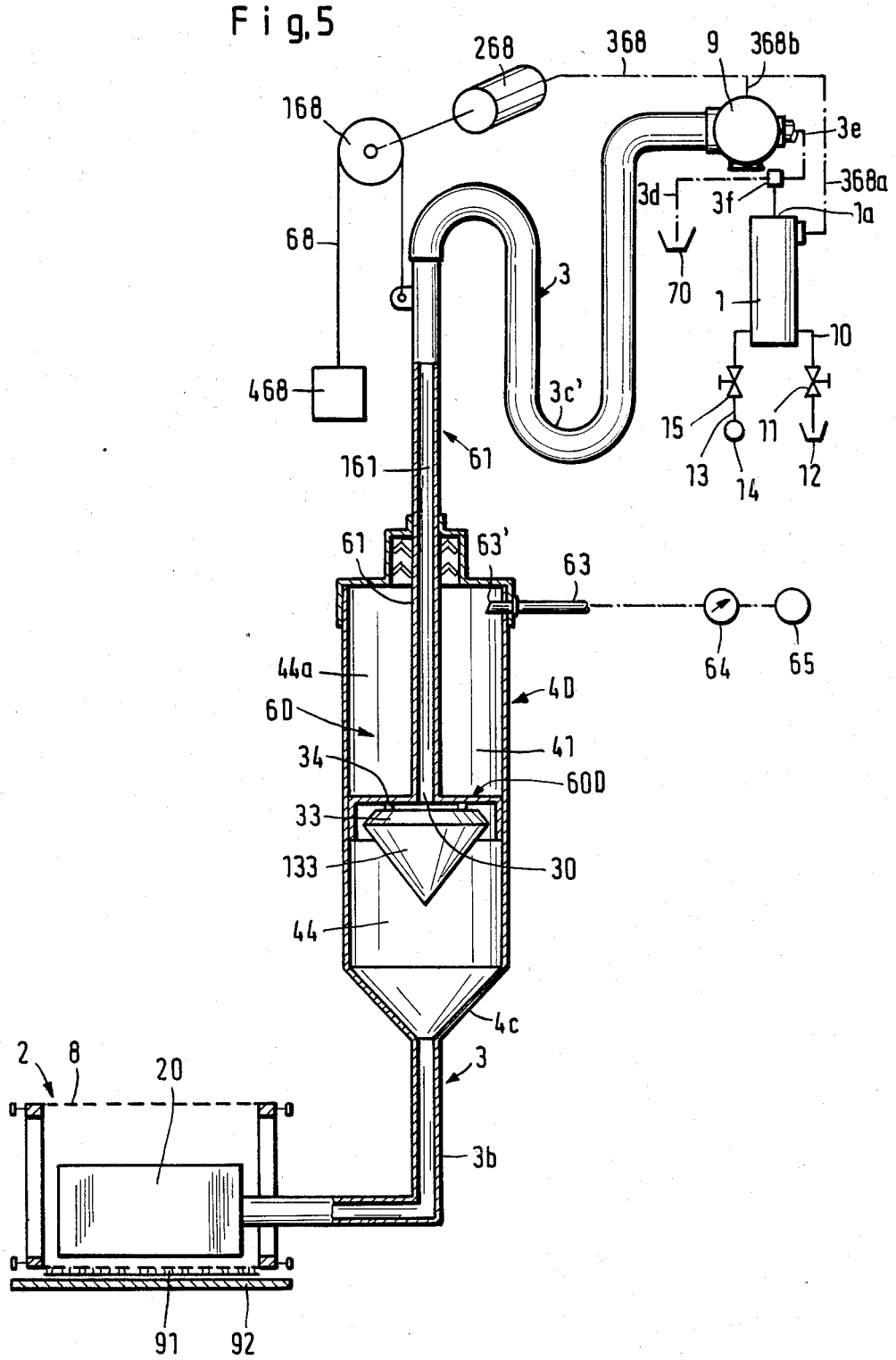
FIG. 5 is a schematic partly elevational and partly sectional view of an additional apparatus wherein the compensating device differs from those shown in FIGS. 3 and 4 and wherein the compensating device effects changes in the rate of delivery of foam to the storing device in a manner other than that shown in FIG. 4.

FIG. 5 shows a further embodiment of the improved apparatus which comprises a consumer 2, a storing device 4D forming part of means for connecting the consumer 2 with a dynamic or static foam generator 1, and a compensating device 6D which is somewhat similar to the compensating device 6B of FIG. 4. The storing device 4D is installed between the section **3*b* (e.g., a rigid pipe) and a flexible section 3*c*' of the conduit 3, and this storing device is capable of accommodating requisite quantities of foam so as to allow for fluctuations in the requirements of the consumer 2 (including intermittent stoppage of the consumer) while the foam generator 1 continues to supply foam to the conduit 3. The consumer 2 comprises a screen 8 (e.g., a cylinder which is driven to rotate about a preferably horizontal axis) and a squeegee 20 which is installed in the interior of the screen and serves to cause the liquid constituent of the foam to pass through the interstices of the screen and into contact with a substrate 91, e.g., with the nap of a carpet which rests on and can be transported by an endless printing blanket 92**.

The flexible section **3*c*' of the conduit 3 is permanently or separably coupled to the exposed rear end portion of a piston rod 61 which, together with the piston 60D, constitutes the compensating device 6D in the cylindrical portion of the storing device 4D. Suitable seal or seals (not specifically shown) can be provided between the skirt of the inverted cup-shaped piston 60D and the internal surface of the cylindrical portion of the storing device 4D so that the piston 60D separates the foam-filled chamber 44 of the storing device from a gas-filled rear chamber 44*a* which contains a supply or cushion 41 of compressed gaseous fluid, e.g., air. The outlet 30 of the passage or channel 161 in the piston rod 61 is affixed to the transverse wall of the piston 60D so that it can discharge foam into the chamber 44**.

The static or dynamic foam generator 1 receives the liquid fraction of the foam from a source 12 via conduit 10 which contains a preferably adjustable flow regulating valve 11. The gaseous fraction of foam is supplied from a source 14 of compressed air (or another suitable gas) by way of a conduit 13 which contains a preferably adjustable flow regulating valve 15. The valves 11 and 15 can be adjusted manually and/or automatically so as to vary or to prevent variations of the consistency of foam which is supplied to the rearmost section **3*e* of the conduit 3**.

The conduit section **3*e* can admit foam into a pump 9 (which is optional) or into a conduit section 3*d* serving as an overflow means which discharges the surplus of foam into a suitable collecting receptacle 70. It is further possible to provide a bypass which receives the surplus of foam so that the quantity of foam which is admitted to the section 3*c*' does not exceed a preselected value. A three-way value 3*f* at the junction of the conduit sections 3*d* and 3*e* can be set to partially or fully seal the outlet of the foam generator 1 from each of these sections, to connect the foam generator 1 with the section 3*d*, to connect the foam generator with the section 3*e*, or to connect the foam generator with each of the sections 3*d*, 3*e***.

The pump 9 is or may be of the adjustable type and is installed between the sections **3*e*, 3*c*' of the conduit 3, i.e., all of the foam which enters the storing device 4D will pass through the pump 9 (provided that such pump is used at all). As a rule, a pump will be needed only if the foam generator 1 cannot ensure spontaneous flow of foam from the outlet 1*a* into the chamber 44 of the storing device 4D**.

The cushion 41 of compressed gaseous fluid in the rear chamber **44*a* of the storing device 4D is formed by gaseous fluid which is supplied by a source 65 via conduit means 63 constituting a pressure line whose outlet 63' is located in the chamber 44*a*. The reference character 64 denotes a valve which is installed in the pressure line 63 and can serve to regulate the pressure in the chamber 44*a* independently of the axial position of the piston 60D and which can also include a suitable gauge to indicate the pressure in the chamber 44*a***.

The section **3*c*' of the conduit 3 is flexible in order to enable the piston rod 61 to move up or down (as viewed in FIG. 5) in dependency on the momentary volume of the foam confining chamber 44. The axial position of the piston 60D and its piston rod 61 is monitored in a manner which departs from the manner shown in FIG. 4. Thus, the exposed portion of the piston rod 61 has a lug which is connected with one end portion of a flexible element 68 (e.g., a chain) which is trained over and can rotate a rotary monitoring element 168, e.g., a gear or sprocket wheel which transmits torque to an adjusting device 268, e.g., a transducer serving to transmit signals via conductor means 368. The purpose of the adjusting device 268 is to regulate the rate of admission of foam into the channel or passage 161 of the compensating device 6D including the piston 60D and piston rod 61. The adjusting device 268 can directly influence the foam generator 1, the pump 9 and/or the valve 3*f*. FIG. 5 shows operative connections 368*a* and 368*b* which respectively connect the conductor 368 with the foam generator 1 and pump 9. The connection 368*a* is necessary if the means for supplying foam to the pump 9** comprises a dynamic foam generator.

The left-hand end portion of the flexible element 68 is attached to a counterweight 468 which tends to lift the compensating device 6D against the opposition of the cushion 41 of compressed gaseous fluid in the rear chamber **44*a* of the storing device 4D. For example, when the piston 60D is held in a neutral position corresponding to the average or desired quantity of foam in the chamber 44, the pressure in the chamber 44*a*** can equal or approximate 1 bar.

The squeegee 20 in the screen 8 of the consumer 2 shown in the lower left-hand portion of FIG. 5 may be of the type disclosed in the aforementioned German Pat. No. 20 26 492. The screen 8 is assumed to rotate when the substrate 91 is in motion in a direction at right angles to the plane of FIG. 5. The just mentioned German patent describes the construction and the mode of mounting and driving a screen which can be used in the consumer 2 of FIG. 5. However, it is equally within the purview of the invention to employ a consumer which does not utilize the parts 8 and 20, e.g., to employ a consumer which utilizes sets of nozzles for the discharge of the liquid fraction of foam against the exposed side of substrate therebelow. Such consumers are disclosed, for example, in commonly owned U.S. Pat. No. 4,131,000.

The chamber 44 of the storing device 4D contains a distributor or guide 33 which is closely adjacent to the underside of the piston 60D and compels the foam entering via outlet 30 to flow radially of the piston prior to entering the main portion of the chamber 44. The distributor 33 is secured to the underside of the piston 60D by distancing pins 34 so that it cannot seal the outlet 30 of the channel 161. The lower portion 133 of the distributor 33 constitutes a cone which can act not unlike a valving element to seal the section **3*b* of the conduit 3 from the chamber 44 when the volume of this chamber is reduced to zero or close to zero. The frustoconical portion 4*c* of the storing device 4D then constitutes a seat for the conical portion 133**.

The operation of the apparatus which is shown in FIG. 5 is as follows:

The static or dynamic foam generator 1 supplies foam to the conduit 3 whereby such foam passes through the storing device 4D and reaches the consumer 2. The pump 9 is optional, i.e., the section **3*e* can constitute the rearmost part of the section 3*c*'. The foam which leaves the section 3*c*' flows in the channel 161 of the compensating device 6D and enters the chamber 44 whence it flows into the section 3*b* of the conduit 3. The piston 60D rises against the opposition of the cushion 41 in the rear chamber 44*a* when the section 3*b* and the consumer 2 are filled with foam. For example, the consumer 2 can be said to be filled if the slot of a doctor-like squeegee is filled with foam or if the interior of a hollow roller-shaped squeegee is filled with foam. If the squeegee is a hollow roller-shaped body, its shell has an axially parallel slot to allow the foam to pass toward and to penetrate through the interstices in the adjacent portion of the rotating screen 8**.

As a rule, or at least in many instances, the requirements of the consumer 2 are less than the output of the foam generator 1 when the latter turns out foam at a maximum rate. Therefore, the quantity of foam which is confined in the chamber 44 of the storing device 4D increases and the cushion 41 of gaseous fluid in the chamber **44*a* is compressed accordingly. The resulting upward movement of the piston rod 61 is assisted by the counterweight 468 whereby the rotary monitoring element 168 causes the adjusting means 268 to transmit an appropriate signal via conductor 368. Such signal is used to reduce the output of the foam generator 1 and/or to reduce the rate of flow of foam through the pump 9. The arrangement may be such that the adjusting means 268 adjusts the foam generator 1 and/or the pump 9 in stepwise fashion or infinitely, i.e., in response to each and every axial displacement of the piston rod 61. Infinite adjustment is especially simple if the adjusting means 268 is designed or selected to adjust the pump 9** because the output of a pump for the transport of foam can be readily varied incrementally or infinitely.

If the output of the foam generator 1 is reduced to a value less than the requirements of the consumer 2, or if the requirements of the consumer increase, the quantity of foam which is stored in the chamber 44 begins to decrease and the cushion 41 in the chamber **44*a* expands to move the piston rod 61 downwardly so that the pressure in the chamber 44 remains substantially unchanged. The adjusting means 268 responds when the piston rod 61 reaches a predetermined axial position (i.e., when the rotary monitoring element 168 assumes a predetermined angular position or completes a preselected number of revolutions) so that the output of the foam generator 1 and/or the output of the pump 9 is increased in order to replenish the supply of foam in the chamber 44. The adjustments of the three-way valve 3*f* can follow the adjustment of the pump 9, i.e., the section 3*d* of the conduit 3 can receive a larger quantity of foam if the rate of admission of foam from the pump 9 to the channel 161** is reduced, and vice versa.

It is also possible to simplify the construction of the apparatus which is shown in FIG. 5 by providing manual controls for at least some of the adjustable constituents of this apparatus. For example, the apparatus can be provided with manual controls in addition to automatic controls so that, if necessary, an attendant can start the apparatus after a certain period of idleness by carrying out all adjustments which are necessary to establish and maintain a requisite minimum supply of satisfactory foam in the chamber 44 of the storing device 4D.

In the apparatus of FIG. 5, the position of the piston 60D with reference to the storing device 4D is indicative of the ability of the storing device to receive additional foam. Therefore, the monitoring means including the rotary element 168 causes the adjusting device 268 to generate signals which are indicative of the position of the piston 60D and are used to regulate the rate at which the foam generator 1 turns out foam, the rate at which the pump 9 delivers foam to the section **3*c*' of the conduit 3 and/or the rate at which the adjustable valve 3*f* diverts surplus foam into the collecting receptacle 70. The admission of foam to the pump 9 can be shut off completely if the consumer 2 is idle for longer intervals of time while the outlet 1*a* of the foam generator 1 continues to deliver foam; the foam is then admitted solely into the receptacle 70**.

The piston rod 61 can be said to form part of the section **3*c*' of the conduit 3 or vice versa. In other words, the conduit 3 can be said to be connected directly to the piston 60D** of the compensating device.

The distributor 33 can be replaced by another distributor, e.g., a distributor whose front portion defines with the storing device 4D two or more passages for the flow of foam from the channel 161, through the chamber 44, and on to the consumer 2.

Figure 6:
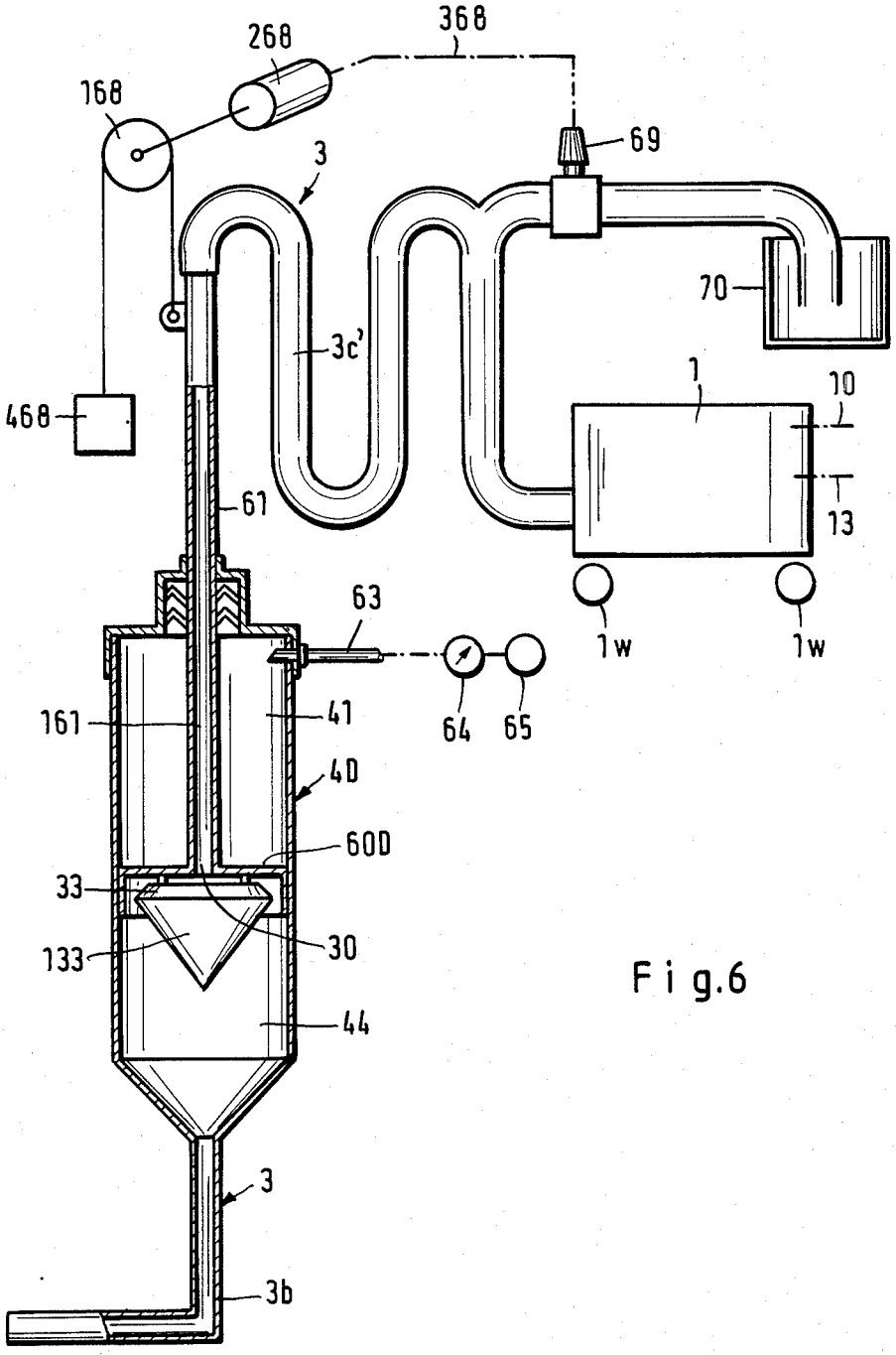
FIG. 6 is a similar schematic partly elevational and partly sectional view of an apparatus which constitutes a first modification of the apparatus shown in FIG. 5.

The apparatus of FIG. 6 constitutes a modification of the apparatus which is illustrated in FIG. 5. Those parts of the modified apparatus which are identical with or clearly analogous to the corresponding parts of the apparatus shown in FIG. 5 are denoted by similar reference characters.

The foam generator 1 supplies foam to the conduit 3 at a constant rate. It respectively receives liquid and gaseous fractions via conduits 10, 13 and, if desired, can be mounted on wheels **1*w* for convenient transport to and from the locale of use. The conduit 3 admits foam into the storing device 4D wherein the foam fills the chamber 44 and flows through the section 3*b*** to the consumer, not shown. The piston 60D of the compensating device rises or falls, depending on the ratio of foam consumption to foam generation. The adjusting means 268 transmits signals whose intensity and/or other characteristics vary as a function of the axial position of the piston rod 61 and which are indicative of the quantity of foam in the chamber 44 of the storing device 4D. The conductor 368 transmits such signals to a preferably infinitely adjustable bypass valve 69 which regulates the flow of surplus foam into a collecting receptacle 70 (in lieu of admission into the conduit section 3c'). After remaining in the receptacle 70 for a certain period of time, the foam loses its bubbles and the remaining constituent (liquid) can be admitted into the conduit 10 for reintroduction into the foam generator 1. The interval of decay of foam in the receptacle 70 depends on the nature of the constituents of the substance flowing in the conduit 3.

Figure 7:
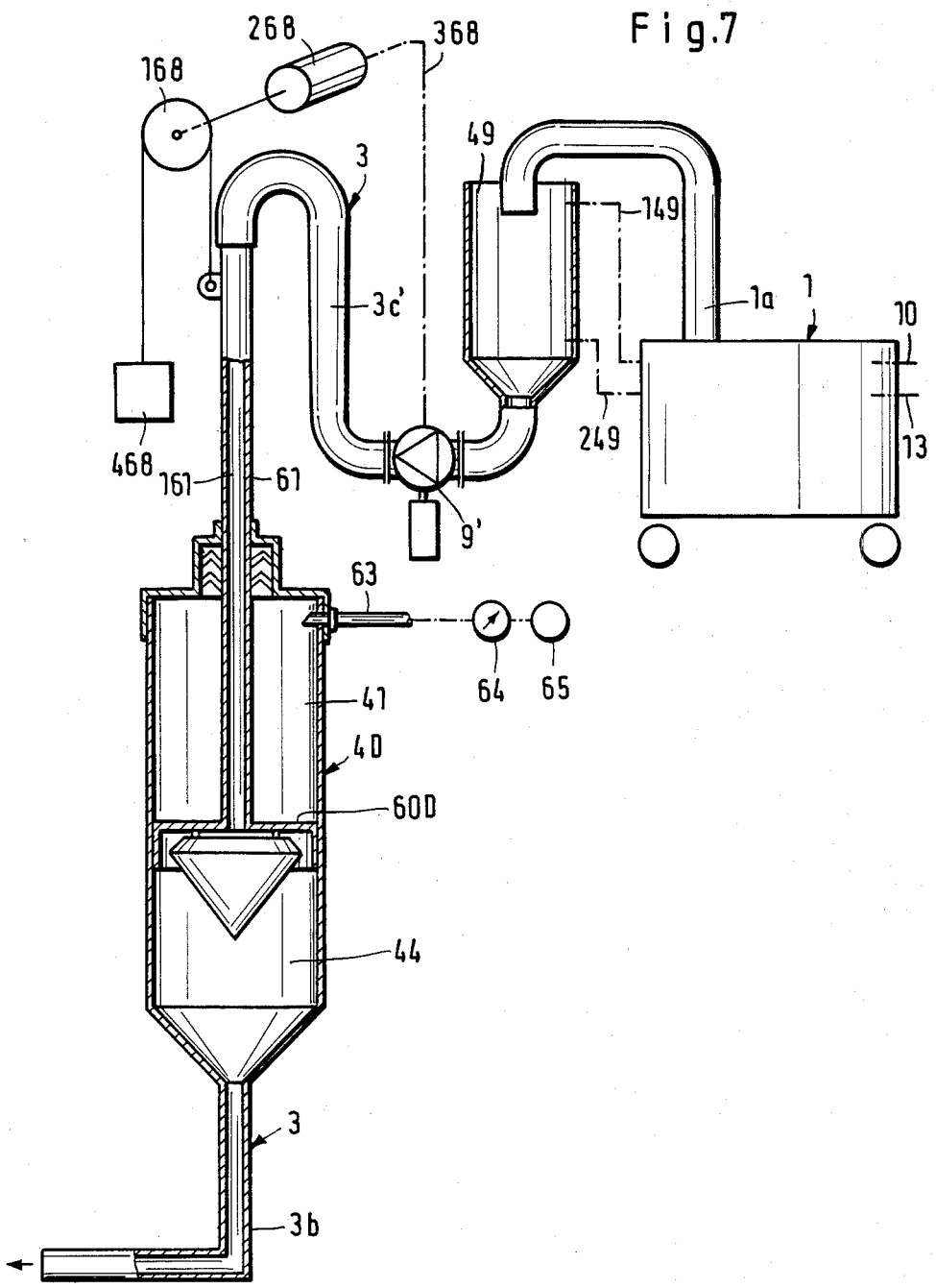
FIG. 7 is a similar schematic partly elevational and partly sectional view of an apparatus which constitutes a second modification of the apparatus shown in FIG. 5.

The apparatus of FIG. 7 constitutes a second modification of the apparatus which is shown in FIG. 5; again, all such parts which are identical with or clearly analogous to the corresponding parts of the apparatus shown in FIG. 5 are denoted by similar reference characters.

The apparatus which is depicted in FIG. 7 employs an adjustable wheel-mounted foam generator 1 whose outlet 1a delivers a continuous stream of foam into an intermediate or auxiliary storing device 49 located upstream of an adjustable pump 9' in or ahead of the flexible section 3c' of the conduit 3. The pump 9' draws foam from the lower portion of the auxiliary storing device 49 and delivers the withdrawn foam to the chamber 44 of the main or primary storing device 4D via conduit section 3c'.

The piston rod 61 of the compensating device in the storing device 4D actuates an adjusting means 268 whose output signal is transmitted to the adjustable pump 9' via conductor means 368 so that the rate of foam admission into the chamber 44 rises and falls proportionally with (i.e., as a function of) the extent to which the storing device 4D is filled with foam.

The auxiliary storing device 49 is provided with a pair of level detectors 149, 249 foaming part of a means for regulating the operation of the adjustable foam generator 1 so that the output of this foam generator increases when it receives a signal from the lower level detector 249 and that the output of the foam generator 1 decreases when it receives a signal from the upper level detector 149. Each of these level detectors may be responsive to contact or absence of contact with foam in the respective portion of the auxiliary storing device 49, or each of these level detectors may constitute or include a photoelectronic transducer of any known design. The exact manner in which the signals from the level detectors 149, 249 are processed to regulate the operation of the foam generator 1 forms no part of the invention. For example, such signals can be used to throttle or enhance the flow of liquid in the conduit 10 and the flow of gaseous fluid in the conduit 13.

Figure 8:
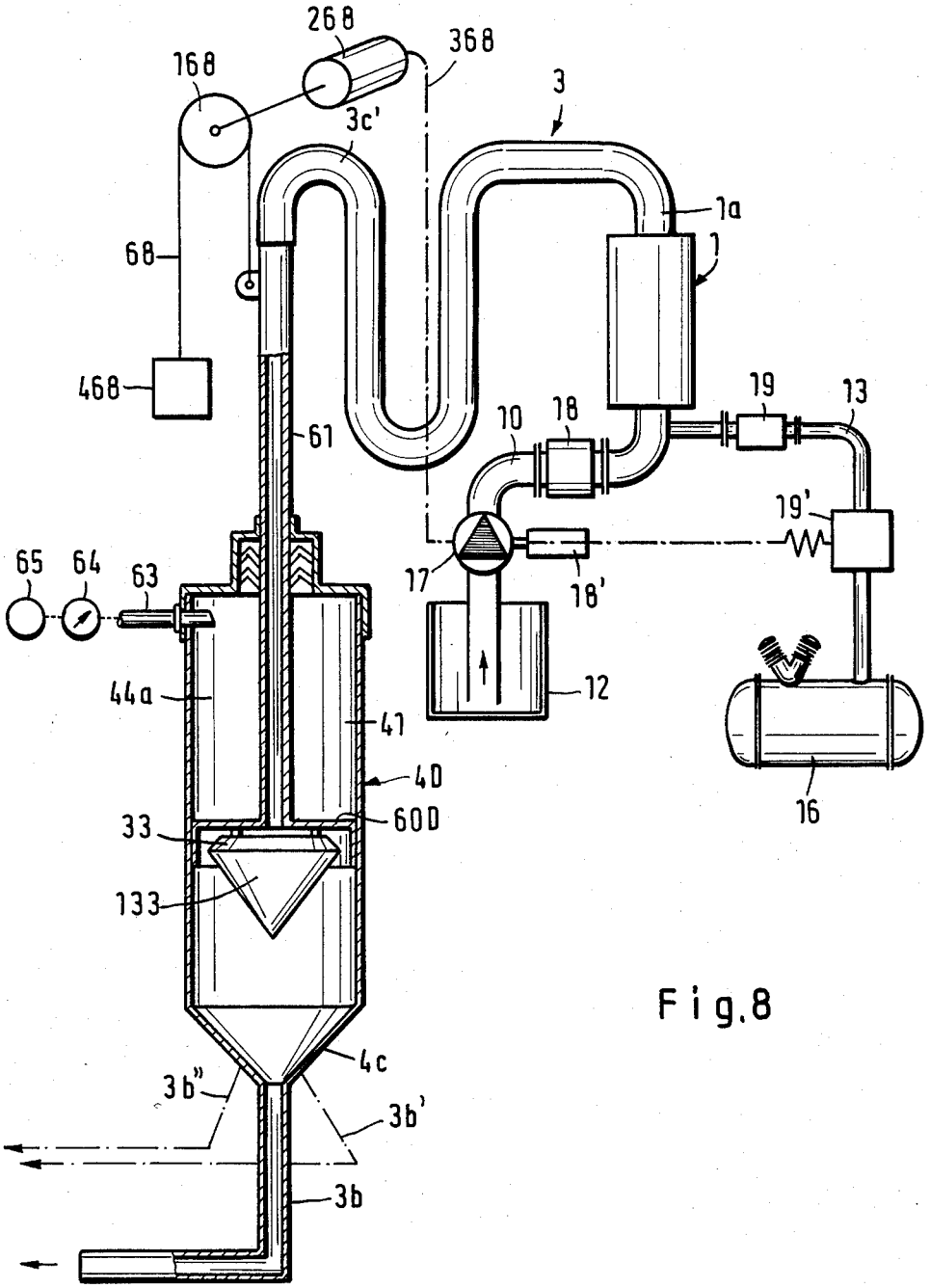
FIG. 8 is a similar schematic partly elevational and partly sectional view of an apparatus which constitutes an additional modification of the apparatus shown in FIG. 5.

The construction of the apparatus which is shown in FIG. 8 departs from the construction of the apparatus of FIG. 5, 6 or 7 in that the adjusting means 268 serves to adjust the means for supplying liquid and gaseous constituents to the foam generator 1. To the extent that the parts of the apparatus shown in FIG. 8 are identical with or analogous to the corresponding parts of the apparatus of FIG. 5, they are denoted by similar reference characters.

The reciprocable piston rod 61 of the compensating device in the storing device 4D actuates the rotary monitoring element 168 to cause the adjusting means 268 to transmit appropriate signals via conductor means 368; such signals are indicative of the extent to which the storing device 4D is filled with foam. The conductor means 368 transmits signals to an adjustable flow regulating device here shown as a pump 17 which is installed in a conduit 10 connecting the source 12 of liquid fraction with the foam generator 1. The rate of liquid flow via pump 17 is monitored by a detector 18' of any known design, and the latter transmits signals to an adjustable regulating valve 19' in the conduit 13 connecting the foam generator 1 with a compressor 16 or another suitable source of compressed gaseous fluid. The reference characters 18 and 19 denote proportioning devices which are respectively installed in the conduits 10 and 13. The arrangement is such that the ratio of gas to liquid in the foam which is generated at 1 remains constant irrespective of adjustment of the pump 17 in response to signals from the adjusting means 268. The manner in which the outlet of the foam generator 1 supplies foam to the means (including the conduit 3 and the storing device 4D) which connects the foam generator with the consumer (not shown in FIG. 8) is the same as or similar to that described in connection with FIGS. 5 to 7.

The apparatus of FIG. 8 is susceptible of numerous modifications. For example, the conductor means 368 can transmit signals to a flow regulating device in the conduit 13, and such flow regulating device can initiate the generation of signals for appropriate adjustment of the pump 17 or another suitable liquid flow regulating device so that the ratio of liquid and gas flowing into the foam generator 1 remains unchanged.

It is further possible to modify the apparatus of FIG. 5, 6, 7 and/or 8 by installing in the main or primary storing device 4D one or more additional compensating means, e.g., one or more balloons of the type shown in FIG. 3. Also, and as mentioned with reference to FIG. 5, the conical portion 133 of the distributor 33 shown in FIG. 6, 7 or 8 can constitute a valving element which cooperates with the frustoconical portion 4c of the storing device 4D to seal the section 3b of the conduit 3 from the interior of the storing device. To this end, the conicity of the portion 133 preferably matches or closely approximates that of the portion 4c. The portion 4c can be replaced with a hollow substantially semispherical portion (note the lower portion of the storing device 4A shown in FIG. 3), and the conical portion 133 is then replaced with a complementary hemispherical portion to enable the foam discharging portion of the storing device and the distributor to constitute the seat and the valving element of a valve which prevents the flow of foam into the section 3b of the conduit when the volume of the chamber 44 is reduced to zero or decreases below a preselected minimum permissible value.

If the section 3c' of the conduit 3 is rigid, the piston rod 61 can be replaced with a piston rod including at least one flexible portion connected with the rigid conduit section and at least one rigid portion which is coupled to the flexible element 68.

It is also possible to provide the main or primary storing device (e.g., the device 4D of FIG. 8) with several outlets each of which discharges into a separate conduit serving to deliver foam to the consumer. For example, and as shown in FIG. 8, the portion 4c of the storing device 4D can supply foam to three discrete sections 3*b*, 3*b*′ and 3*b*″ each of which leads to the consumer, such as into the interior of the screen 8 shown in FIG. 5. The arrangement is preferably such that the distance between the outlet 1*a* of the foam generator and the locus where each of the sections 3*b*, 3*b*′, 3*b*″ discharges into the consumer 2 is the same or nearly the same. The supply or cushion 41 of compressed gaseous fluid in the chamber 44*a* of the storing device 4D acts not unlike a spring and ensures that the pressure of foam in the conduit 3*b*, 3*b*′ and/or 3*b*″ is always the same or deviates only negligibly from an optimum pressure.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for applying foam to a substrate, comprising at least one consumer having a hollow rotary screen through which at least the liquid fraction of foam passes into contact with the consumer and an applicator in the interior of said screen; means for feeding foam to said applicator including at least one foam generator having foam discharging outlet means and means for connecting said outlet means with the consumer, said connecting means including at least one conduit and at least one pressurized foam storing device in said conduit; and compensating means for varying the effective volume of said storing device as a function of variations of the quantity of foam and the resulting fluctuations of pressure in said storing device, said compensating means including a portion which is disposed in the interior of said storing device.

2. The apparatus of claim 1, wherein the requirements of said consumer fluctuate and said storing device includes a buffer reservoir arranged to store foam which is generated while the requirements of the consumer are less than the output of said foam generator.

3. The apparatus of claim 1, wherein said consumer is operated intermittently and said storing device includes a buffer reservoir arranged to store foam which is generated while the requirements of the consumer are nil.

4. The apparatus of claim 1, wherein said connecting means further comprises flow regulating means interposed between said storing device and the consumer.

5. The apparatus of claim 4, wherein said flow regulating means includes at least one valve.

6. The apparatus of claim 4, wherein said flow regulating means is adjustable and further comprising means for adjusting said flow regulating means in accordance with a predetermined pattern.

7. The apparatus of claim 4, wherein said flow regulating means is adjustable and further comprising means for adjusting said flow regulating means as a function of changes in the requirements of the consumer.

8. The apparatus of claim 1, wherein said storing device comprises a vessel defining a path for the flow of foam from said foam generator toward the consumer, and at least one foam guide installed in said path.

9. The apparatus of claim 8, wherein said foam guide has a streamlined configuration so as to offer relatively low resistance to the flow of foam therealong.

10. The apparatus of claim 8, wherein said storing device comprises several foam guides in said path.

11. The apparatus of claim 1, wherein said storing device has a foam receiving portion and a foam discharging portion and at least one of said portions constitutes a funnel.

12. The apparatus of claim 1, wherein said storing device comprises a vessel having a foam receiving portion and a foam discharging portion, and a foam guide in each of said portions.

13. The apparatus of claim 12, wherein at least one of said foam guides includes a twin cone.

14. The apparatus of claim 12, wherein one of said portions and the respective guide define an annular passage having an at least substantially constant width.

15. The apparatus of claim 1, wherein said foam generator is adjustable and further comprising means for adjusting said foam generator as a function of variations of the effective volume of said storing device.

16. The apparatus of claim 15, wherein said adjusting means forms part of said compensating means.

17. The apparatus of claim 1, wherein said portion of said compensating means comprises an elastically deformable cushion in said storing device.

18. The apparatus of claim 1, wherein said portion of said compensating means comprises a piston reciprocably received in said storing device and having a piston rod, said piston and said piston rod defining channel means for the flow of foam through said compensating means.

19. The apparatus of claim 18, wherein said storing device comprises a cylinder for said piston, said cylinder having a foam admitting portion at one side of said piston, a foam discharging portion at the other side of said piston, and a chamber for the storage of foam between said piston and said foam discharging portion, said piston rod extending outwardly through said foam admitting portion and being connected with said outlet means so that said channel means admits foam into said chamber.

20. The apparatus of claim 19, further comprising means for biasing said piston in a direction to reduce the volume of said chamber.

21. The apparatus of claim 20, wherein said biasing means comprises at least one weight.

22. The apparatus of claim 18, wherein said foam generator is adjustable and further comprising means for adjusting said foam generator as a function of changes in the position of said piston with reference to said storing device.

23. The apparatus of claim 22 wherein said adjusting means comprises at least one switch actuatable by said piston.

24. The apparatus of claim 1, wherein the applicator comprises at least one squeegee.

25. The apparatus of claim 24, wherein said squeegee comprises at least one slotted blade.

26. The apparatus of claim 24, wherein said squeegee includes first and second end portions and said connecting means is arranged to supply foam to one of said end portions.

27. The apparatus of claim 26, further comprising a second foam generator and second connecting means arranged to deliver foam from said second foam generator to the other end portion of said squeegee.

28. The apparatus of claim 1, wherein said portion of said compensating means comprises a piston which is reciprocable in said storing device and said connecting means further comprises conduit means connecting said outlet means with said piston.

29. The apparatus of claim 28, wherein said conduit means includes a portion constituting a piston rod rigid with said piston and extending from said storing device.

30. The apparatus of claim 29, wherein said piston divides the interior of said storing device into first and second chambers and said storing device has a foam discharging portion communicating with one of said chambers, said piston and said piston rod defining a channel for admission of foam from said foam generator into said one chamber.

31. The apparatus of claim 29, further comprising means for monitoring the quantity of foam in said storing device, including means for generating signals in response to movement of said piston and said piston rod with reference to said storing device.

32. The apparatus of claim 31, wherein said foam generator is adjustable and said monitoring means includes means for adjusting said foam generator in response to said signals.

33. The apparatus of claim 31, further comprising adjustable pump means in said conduit means, said monitoring means including means for adjusting said pump means in response to said signals.

34. The apparatus of claim 31, further comprising adjustable valve means in said conduit means, said monitoring means including means for adjusting said valve means in response to said signals.

35. The apparatus of claim 29, wherein said piston divides the interior of said storing device into first and second chambers and said storing device has a foam discharging portion communicating with one of said chambers, said piston and said piston rod defining a channel for admission of foam from said foam generator to said one chamber and further comprising foam distributor means installed in said one chamber.

36. The apparatus of claim 35, wherein said channel has an outlet communicating with said one chamber and said distributor means is spaced apart from the outlet of said channel.

37. The apparatus of claim 36, wherein said distributor means comprises an extension facing said foam discharging portion and defining with said storing device at least one passage for the flow of foam from said channel, through said one chamber and on to the consumer.

38. The apparatus of claim 29, wherein said conduit means further comprises a flexible portion arranged to convey foam from said foam generator into said piston rod.

39. The apparatus of claim 29, wherein said piston divides the interior of said storing device into first and second chambers and said storing device has a foam discharging portion communicating with one of said chambers, said piston and said piston rod defining a channel for admission of foam into said one chamber and further comprising means for urging said piston in a direction to increase the volume of said one chamber.

40. The apparatus of claim 39, wherein said urging means comprises at least one weight connected to said piston rod.

41. The apparatus of claim 28, wherein said connecting means is arranged to supply foam to one side of said screen, said consumer further comprising means for inducing the flow of foam through said screen.

42. The apparatus of claim 1, further comprising at least one additional connecting means between said outlet means and the consumer, each of said connecting means defining a path for the flow of foam from said outlet means, through the respective storing device and to the consumer, said paths having at least substantially identical lengths.

* * * * *